US010569567B2

(12) United States Patent
Kuno et al.

(10) Patent No.: US 10,569,567 B2
(45) Date of Patent: Feb. 25, 2020

(54) THERMAL TRANSFER DEVICE THAT USES LIGHT ENERGY TO RELIABLY APPLY FOIL TO TRANSFER OBJECT

(71) Applicant: DGSHAPE Corporation, Hamamatsu-shi, Shizuoka (JP)

(72) Inventors: Tsutomu Kuno, Hamamatsu (JP); Tomoyoshi Masuda, Hamamatsu (JP)

(73) Assignee: DGSHAPE CORPORATION, Shizuoka (JP)

( * ) Notice: Subject to any disclaimer, the term of this patent is extended or adjusted under 35 U.S.C. 154(b) by 0 days.

(21) Appl. No.: 16/140,574

(22) Filed: Sep. 25, 2018

(65) Prior Publication Data

US 2019/0092041 A1 Mar. 28, 2019

(30) Foreign Application Priority Data

Sep. 27, 2017 (JP) ..... 2017-186424

(51) Int. Cl.

| | |
|---|---|
| ***B41J 2/48*** | (2006.01) |
| ***B41M 5/46*** | (2006.01) |
| ***B41M 5/42*** | (2006.01) |
| ***B41J 2/475*** | (2006.01) |
| ***B41F 16/00*** | (2006.01) |

(52) U.S. Cl.

CPC ..... *B41J 2/48* (2013.01); *B41F 16/0046* (2013.01); *B41J 2/475* (2013.01); *B41M 5/42* (2013.01); *B41M 5/46* (2013.01)

(58) Field of Classification Search

CPC ... B41J 2/48; B41J 2/475; B41M 5/46; B41M 5/42; B41F 16/0046

See application file for complete search history.

(56) References Cited

U.S. PATENT DOCUMENTS

2018/0333964 A1* 11/2018 Sawamura ..... B41M 5/28

FOREIGN PATENT DOCUMENTS

JP 2016-215599 A 12/2016
JP 2016215599 * 12/2016 ..... B41J 2/48

* cited by examiner

*Primary Examiner* — Henok D Legesse
(74) *Attorney, Agent, or Firm* — Keating & Bennett, LLP

(57) ABSTRACT

A thermal transfer device includes a fixture that holds a transfer object, a foil transfer tool that presses a thermal transfer foil placed on the transfer object and a light absorbing film placed on the thermal transfer foil and emits light onto the light absorbing film, a carriage moving mechanism that moves the foil transfer tool relative to the fixture, and a temperature detector that measures a temperature of a portion of the light absorbing film pressed and irradiated with light by the foil transfer tool.

4 Claims, 5 Drawing Sheets

THERMAL TRANSFER DEVICE THAT USES LIGHT ENERGY TO RELIABLY APPLY FOIL TO TRANSFER OBJECT

CROSS REFERENCE TO RELATED APPLICATIONS

This application claims the benefit of priority to Japanese Patent Application No. 2017-186424 filed on Sep. 27, 2017. The entire contents of this application are hereby incorporated herein by reference.

BACKGROUND OF THE INVENTION

1. Field of the Invention

The present invention relates to a thermal transfer device. Specifically, the present invention relates to a thermal transfer device that performs a foil transfer onto a transfer object using a thermal transfer foil.

2. Description of the Related Art

Conventionally, a decorative process using a thermal transfer method has been performed by using a thermal transfer foil (referred to also as a thermal transfer sheet) in order to improve the design, etc. A thermal transfer foil is generally composed of a base material, a decorative layer, and an adhesive layer. When foil-transferring (i.e., transferring a thermal transfer foil onto a transfer object), a thermal transfer foil is laid on a transfer object so that the adhesive layer is in contact with the transfer object, and a laser light emitting tool (e.g., a laser pen) is used to press down the thermal transfer foil while heating the thermal transfer foil by irradiating it with light. This melts the adhesive layer of the pressed portion of the thermal transfer foil, and the adhesive layer sticks to the surface of the transfer object and cures through heat radiation. As a result, when the base material of the thermal transfer foil is peeled off the transfer object, a piece of the decorative layer shaped corresponding to the foil-stamped portion can be left stuck on the transfer object, together with the adhesive layer. Thus, a decoration of any design pattern, etc., can be applied to the surface of the transfer object.

For example, Japanese Laid-Open Patent Publication No. 2016-215599 discloses a technique of foil-transferring onto a transfer object using a laser light emitting tool.

Now, when foil-transferring a thermal transfer foil onto a transfer object using a laser light emitting tool, there is a need to irradiate a portion that is being pressed by the tool with light to increase the process temperature of the portion to a predetermined temperature range. The temperature range is determined based on the thermal transfer foil used. Depending on the thermal capacity of the transfer object, the process temperature of the portion being irradiated with light may vary for the same light energy input. The process temperature being too high may possibly lead to evaporation of the adhesive layer, or the like, resulting in an insufficient adhesive strength between the thermal transfer foil and the transfer object. On the other hand, the process temperature being too low may possibly lead to insufficient melting of the adhesive layer, resulting in an insufficient adhesive strength between the thermal transfer foil and the transfer object.

SUMMARY OF THE INVENTION

Preferred embodiments of the present invention provide thermal transfer devices each capable of more reliably performing a foil transfer onto a transfer object.

A thermal transfer device according to a preferred embodiment of the present invention includes a holding table that holds a transfer object; a foil transfer tool that presses a thermal transfer foil placed on the transfer object and a light absorbing film with a light absorbing property placed on the thermal transfer foil and emits light onto the light absorbing film; a moving mechanism that moves one of the holding table and the foil transfer tool relative to the other; and a temperature detector that measures a process temperature, which is a temperature of a portion of the light absorbing film pressed and irradiated with light by the foil transfer tool.

With a thermal transfer device according to a preferred embodiment of the present invention, it is possible to measure the process temperature, which is the temperature of a portion of the light absorbing film pressed by the foil transfer tool while being irradiated with light (i.e., the temperature based on heat generated in the light absorbing film). Thus, it is possible to check whether or not the process temperature is within an optimal temperature range for the foil transfer of the thermal transfer foil onto the transfer object. That is, when the process temperature is below the temperature range, it is possible to increase the light energy to be emitted from the foil transfer tool to increase the process temperature so that the thermal transfer foil is able to be more reliably transferred onto the transfer object. On the other hand, when the process temperature is above the temperature range, it is possible to decrease the light energy to be emitted from the foil transfer tool to decrease the process temperature so that the thermal transfer foil is able to be more reliably transferred onto the transfer object. Since it is possible to measure the process temperature during the foil transfer, it is possible to more reliably foil-transfer a thermal transfer foil onto a transfer object even when the material, etc., of the transfer object are unknown and the light energy cannot be precisely set in advance.

According to preferred embodiments of the present invention, it is possible to provide thermal transfer devices capable of more reliably performing a foil transfer onto a transfer object.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will now be described with reference to the drawings. Note that the preferred embodiments to be described herein are not intended to limit the present invention. Members or elements with the same function will be denoted by the same reference signs, and redundant descriptions will be omitted or simplified as appropriate.

Figure 1:
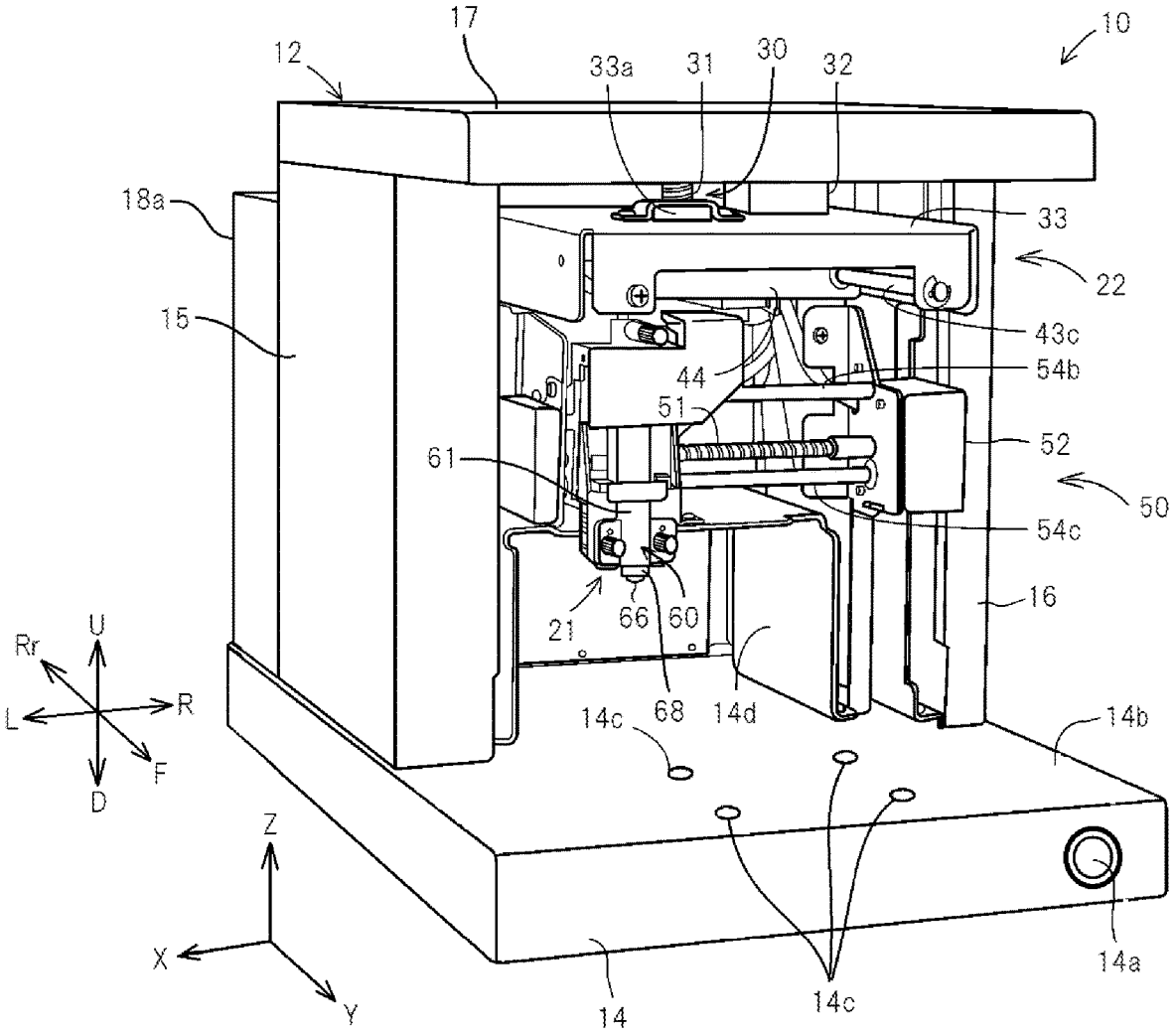
FIG. 1 is a perspective view schematically showing a thermal transfer device according to a preferred embodiment of the present invention.
Figure 2:
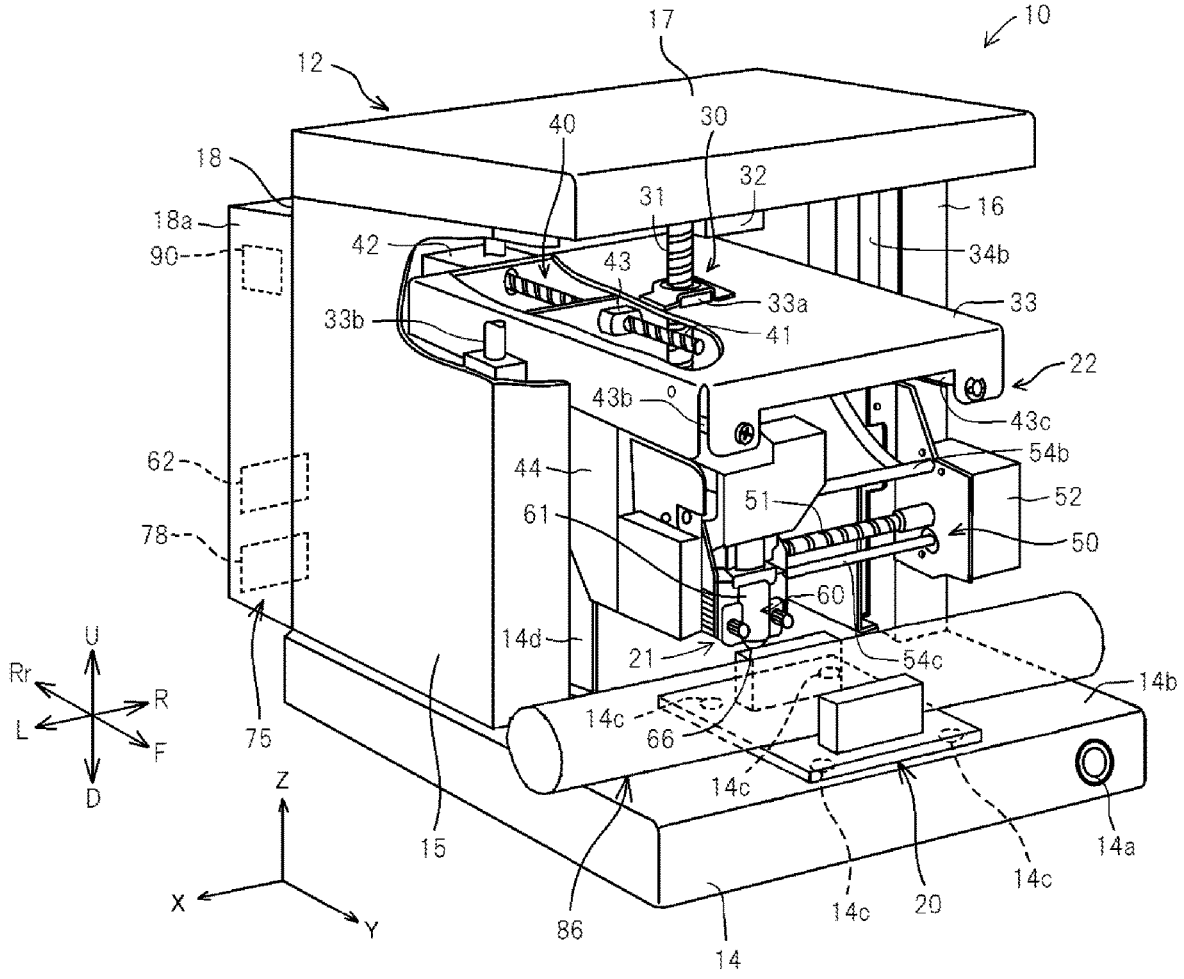
FIG. 2 is a partially cutaway perspective view schematically showing a mode of operation during a foil transfer according to a preferred embodiment of the present invention.
Figure 3:
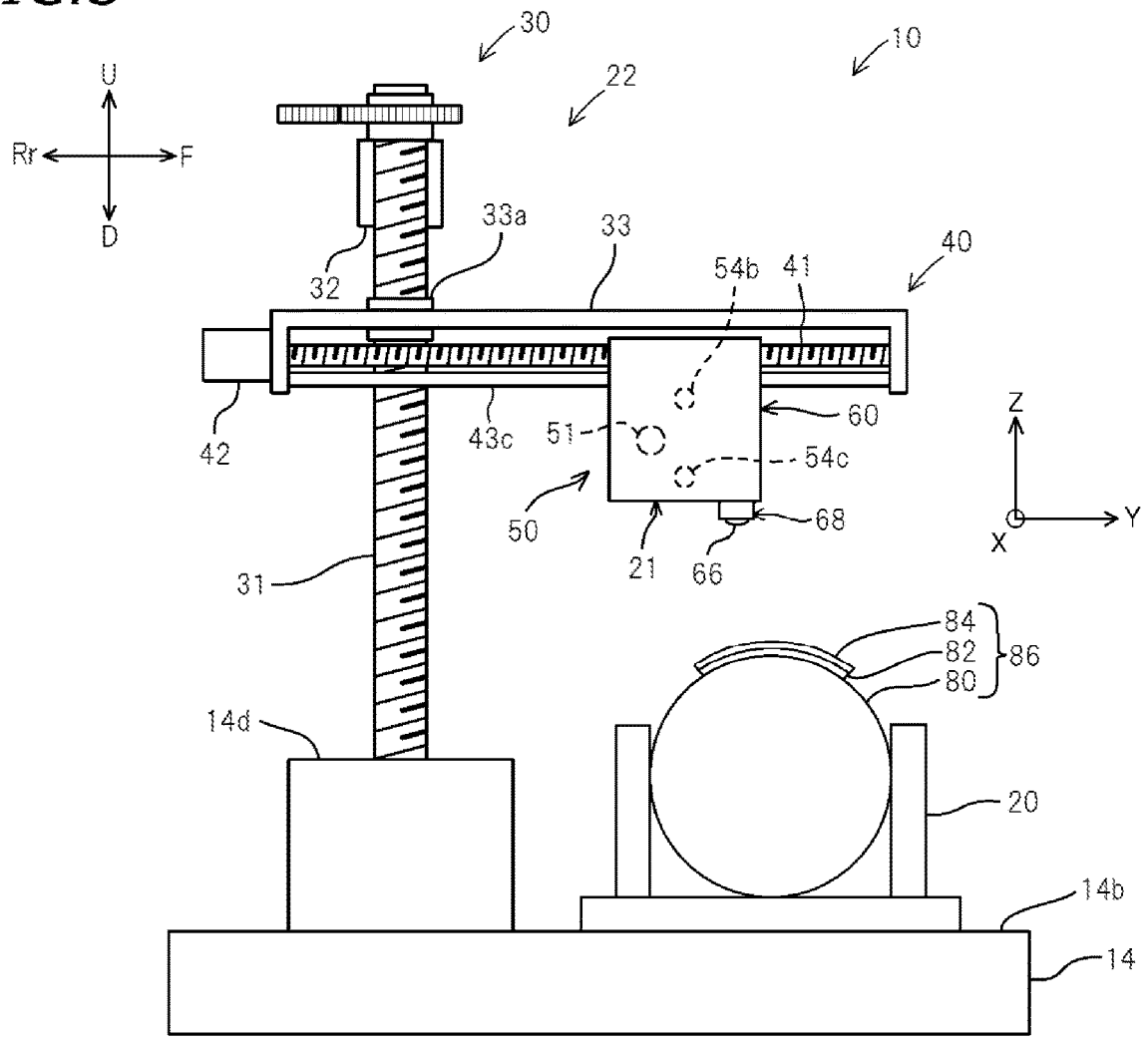
FIG. 3 is a left side view schematically showing a carriage moving mechanism according to a preferred embodiment of the present invention.

First, a configuration of a thermal transfer device 10 will be described. FIG. 1 is a perspective view showing the thermal transfer device 10. FIG. 2 is a partially cutaway perspective view schematically showing a mode of operation of the thermal transfer device 10 during a foil transfer. FIG. 3 is a left side view schematically showing a carriage moving mechanism 22. The terms "left", "right", "up" and "down", as used in the description below, refer to these directions as a power switch 14*a* is seen from the operator (user) in front of the thermal transfer device 10. The direction from the operator toward the thermal transfer device 10 will be referred to as "rear", and the opposite direction as "front". The designations F, Rr, L, R, U and D, as used in the figures, refer to front, rear, left, right, up and down, respectively. It is assumed that where the X axis, the Y axis and the Z axis are orthogonal to each other, the thermal transfer device 10 of the present preferred embodiment is placed on a plane that is defined by the X axis and the Y axis. Herein, the X axis extends in the left-right direction. The Y axis extends in the front-rear direction. The Z axis extends in the up-down direction. Note however that these directions are defined as described above merely for the purpose of illustration, and it is not intended to impose any limitation on how the thermal transfer device 10 is installed.

As shown in FIG. 3, the thermal transfer device 10 is a device in which a foil transfer tool 60 to be described below is used to press and heat a sheet-shaped thermal transfer foil 82 and a sheet-shaped light absorbing film 84, laid on a transfer object 80 to apply a decorative layer of the thermal transfer foil 82 onto the surface of the transfer object 80. The thermal transfer foil 82 is indirectly pressed against the foil transfer tool 60 with the light absorbing film 84 therebetween. Note that depending on the combination of the transfer object 80 and the thermal transfer foil 82, there may not be a need to use the light absorbing film 84. In the following description, the object to be "pressed and heated", i.e., the transfer object 80, the thermal transfer foil 82 and the light absorbing film 84, etc., may be referred to collectively as a processed object 86.

There is no particular limitation on the material and shape of the transfer object 80. For example, the transfer object 80 may be a metal such as gold, silver, copper, platinum, brass, aluminum, iron, titanium, stainless steel, or the like, a resin such as acrylic, polyvinyl chloride (PVC), polyethylene terephthalate (PET), polycarbonate (PC), or the like, a paper such as plain paper, drawing paper, Japanese paper, or the like, a rubber, etc.

For example, the thermal transfer foil 82 may be any of transfer foils sold on the market for thermal transfer. The thermal transfer foil 82 typically includes a base material, a decorative layer and an adhesive layer layered together in this order. The decorative layer of the thermal transfer foil 82 includes a metallic foil such as a gold foil or a silver foil, a half metallic foil, a pigment foil, a multicolor printing foil, a hologram foil, an anti-electrostatic breakdown foil, etc.

Depending on the configuration of the thermal transfer foil 82 used, there may be those that have no or little light absorbing property for light emitted from a light source 62 of the foil transfer tool 60 to be described below. In such a case, the light absorbing film 84 may be laid on the upper surface of the thermal transfer foil 82 to obtain the processed object 86. The light absorbing film 84 is a sheet that efficiently absorbs light of a predetermined wavelength range (laser light) emitted from the light source 62 of the foil transfer tool 60 and convert light energy into thermal energy. The light absorbing film 84 has a heat resistance of about 100° C. to about 200° C., for example. The light absorbing film 84 is made of a resin such as polyimide, for example. The light absorbing film 84 is made of a single color, for example. It is preferred that the hue of the light absorbing film 84 is complementary to the color of the laser light emitted from the light source 62 in order to efficiently convert light energy into thermal energy. For example, when the laser light emitted from the light source 62 is blue, it is preferred that the light absorbing film 84 is yellow. Note that the light absorbing film 84 may be provided with a protection film to increase the strength thereof as needed. The protection film has a significantly lower light absorbing property than the light absorbing film 84. The protection film has a higher light transmittance than the light absorbing film 84, and is clear, for example. There is no particular limitation on the material of the protection film. The protection film is made of a plastic film such as polyester, for example.

As shown in FIG. 1, the thermal transfer device 10 preferably has a box shape. The thermal transfer device 10 includes a casing 12 with an open front side, the carriage moving mechanism 22, a carriage 21 and the foil transfer tool 60, which are arranged in the casing 12. The casing 12 includes a bottom wall 14, a left side wall 15, a right side wall 16, a top wall 17 and a rear wall 18 (see FIG. 2). The casing 12 is preferably made of a steel plate, for example.

As shown in FIG. 2, a fixture 20 such as a vise, for example, is removably attached to the bottom wall 14. The fixture 20 is a holding table that holds the transfer object 80 (i.e., the processed object 86). The front area of the bottom wall 14 is a fixture placing area 14*b* where the fixture 20 is placed. Four installment holes 14*c* for the installment of the fixture 20 are provided in a central portion of the fixture placing area 14*b*. The power switch 14*a* is provided on a front surface portion of the bottom wall 14.

As shown in FIG. 2, the left side wall 15 extends upward at the left end of the bottom wall 14. The left side wall 15 is perpendicular or substantially perpendicular to the bottom wall 14. The right side wall 16 extends upward at the right end of the bottom wall 14. The right side wall 16 is perpendicular or substantially perpendicular to the bottom wall 14. The left side wall 15 and the right side wall 16 support the carriage 21 to be described below. The rear wall 18 extends upward at the rear end of the bottom wall 14. The rear wall 18 is connected to the rear end of the left side wall 15 and the rear end of the right side wall 16. A box-shaped case 18*a* is provided on the rear wall 18. A controller 90 to be described below is accommodated in the case 18*a*. The top wall 17 is connected to the upper end of the left side wall 15, the upper end of the right side wall 16 and the upper end of the rear wall 18. A portion of a first moving mechanism 30 to be described below is provided on the top wall 17. A region that is surrounded by the bottom wall 14, the left side wall 15, the right side wall 16, the top wall 17 and the rear wall 18 is the internal space of the casing 12.

The internal space of the casing 12 is a space where the thermal transfer foil 82 is foil-transferred onto the transfer object 80. The carriage 21, and the carriage moving mechanism 22 that moves the carriage 21 in three-dimensional directions are provided in the internal space. The carriage moving mechanism 22 is an example of the moving mechanism. The carriage moving mechanism 22 includes the first moving mechanism 30 that moves the carriage 21 in the Z-axis direction, a second moving mechanism 40 that moves the carriage 21 in the Y-axis direction, and a third moving mechanism 50 that moves the carriage 21 in the X-axis direction. The carriage 21 is able to be moved relative to the fixture 20 (i.e., the processed object 86) by the first moving mechanism 30, the second moving mechanism 40 and the third moving mechanism 50. The first moving mechanism 30, the second moving mechanism 40 and the third moving mechanism 50 are all arranged above the bottom wall 14.

As shown in FIG. 1, the first moving mechanism 30 is a mechanism that moves the carriage 21 in the Z-axis direction (up-down direction). The first moving mechanism 30 is a threaded feeder mechanism including a Z-axis threaded feed rod 31, a Z-axis direction feed motor 32, and a feed nut 33*a*. The Z-axis threaded feed rod 31 extends along the Z axis. The Z-axis threaded feed rod 31 has a helical threaded groove. The top of the Z-axis threaded feed rod 31 is fixed on the top wall 17. The upper end portion of the Z-axis threaded feed rod 31 extends in the Z-axis direction through the lower surface of the top wall 17, and is partially inside the top wall 17. The lower end portion of the Z-axis threaded feed rod 31 is rotatably supported by a frame 14*d* (see also FIG. 3). The frame 14*d* is fixed on the bottom wall 14. The Z-axis direction feed motor 32 is an electric motor. The Z-axis direction feed motor 32 is connected to the controller 90 (see FIG. 2). The Z-axis direction feed motor 32 is fixed on the top wall 17. The drive shaft of the Z-axis direction feed motor 32 extends in the Z-axis direction through the lower surface of the top wall 17, and is partially inside the top wall 17. Inside the top wall 17, the Z-axis threaded feed rod 31 is linked to the Z-axis direction feed motor 32. The Z-axis direction feed motor 32 rotates the Z-axis threaded feed rod 31.

As shown in FIG. 2, the Z-axis threaded feed rod 31 is meshed with the threaded feed nut 33*a*. The feed nut 33*a* is linked to an elevating base 33. The feed nut 33*a* extends in the Z-axis direction through the upper surface of the elevating base 33. The elevating base 33 is supported by the Z-axis threaded feed rod 31 via the feed nut 33*a* therebetween. The elevating base 33 is provided in parallel to the bottom wall 14. The lengths of the elevating base 33 in the X-axis direction and the Y-axis direction are greater than those of the fixture placing area 14*b*. Slide shafts 33*b* and 34*b*, each extending in the Z-axis direction, are provided on the inner side of the left side wall 15 and the right side wall 16, respectively. The slide shafts 33*b* and 34*b* are arranged in parallel or substantially in parallel to the Z-axis threaded feed rod 31. The elevating base 33 is slidable in the Z-axis direction on the slide shafts 33*b* and 34*b*. When the Z-axis direction feed motor 32 is driven, the elevating base 33 moves in the up-down direction along the slide shafts 33*b* and 34*b* by the rotation of the Z-axis threaded feed rod 31. The second moving mechanism 40 and the third moving mechanism 50 are linked to the elevating base 33. Therefore, the second moving mechanism 40 and the third moving mechanism 50 move up and down together with the up-down movement of the elevating base 33.

As shown in FIG. 2, the second moving mechanism 40 moves the carriage 21 in the Y-axis direction (front-rear direction). The second moving mechanism 40 is a threaded feeder mechanism including a Y-axis threaded feed rod 41, a Y-axis direction feed motor 42, and a feed nut 43. The Y-axis threaded feed rod 41 extends along the Y axis. The Y-axis threaded feed rod 41 is provided on the elevating base 33. The Y-axis threaded feed rod 41 has a helical threaded groove. The rear end portion of the Y-axis threaded feed rod 41 is linked to the Y-axis direction feed motor 42. The Y-axis direction feed motor 42 is an electric motor. The Y-axis direction feed motor 42 is connected to the controller 90. The Y-axis direction feed motor 42 is fixed on a rear portion of the elevating base 33. The Y-axis direction feed motor 42 rotates the Y-axis threaded feed rod 41. The threaded feed nut 43 is meshed with the threaded groove of the Y-axis threaded feed rod 41. A pair of slide shafts 43*b* and 43*c* extending in the Y-axis direction are provided on the elevating base 33. The two slide shafts 43*b* and 43*c* are arranged in parallel or substantially in parallel to the Y-axis threaded feed rod 41. A slide base 44 is slidable in the Y-axis direction on the slide shafts 43*b* and 43*c*. When the Y-axis direction feed motor 42 is driven, the slide base 44 moves in the front-rear direction along the slide shafts 43*b* and 43*c* by the rotation of the Y-axis threaded feed rod 41.

As shown in FIG. 1, the third moving mechanism 50 moves the carriage 21 in the X-axis direction (left-right direction). The third moving mechanism 50 is a threaded feeder mechanism including an X-axis threaded feed rod 51, an X-axis direction feed motor 52, and a feed nut (not shown). The X-axis threaded feed rod 51 extends along the X axis. The X-axis threaded feed rod 51 is provided on a front portion of the slide base 44. The X-axis threaded feed rod 51 has a helical threaded groove. One end of the X-axis threaded feed rod 51 is linked to the X-axis direction feed motor 52. The X-axis direction feed motor 52 is an electric motor. The X-axis direction feed motor 52 is connected to the controller 90 (see FIG. 2). The X-axis direction feed motor 52 is fixed on the right side wall surface of the slide base 44 extending in the forward direction. The X-axis direction feed motor 52 rotates the X-axis threaded feed rod 51. The threaded feed nut is meshed with the threaded groove of the X-axis threaded feed rod 51. A pair of slide shafts 54*b* and 54*c* extending in the X-axis direction are provided on a front portion of the slide base 44. The two slide shafts 54*b* and 54*c* are arranged in parallel or substantially in parallel to the X-axis threaded feed rod 51. The carriage 21 is slidable in the X-axis direction on the slide shafts 54*b* and 54*c*. When the X-axis direction feed motor 52 is driven, the carriage 21 moves in the left-right direction along the slide shafts 54*b* and 54*c* by the rotation of the X-axis threaded feed rod 51.

Figure 4:
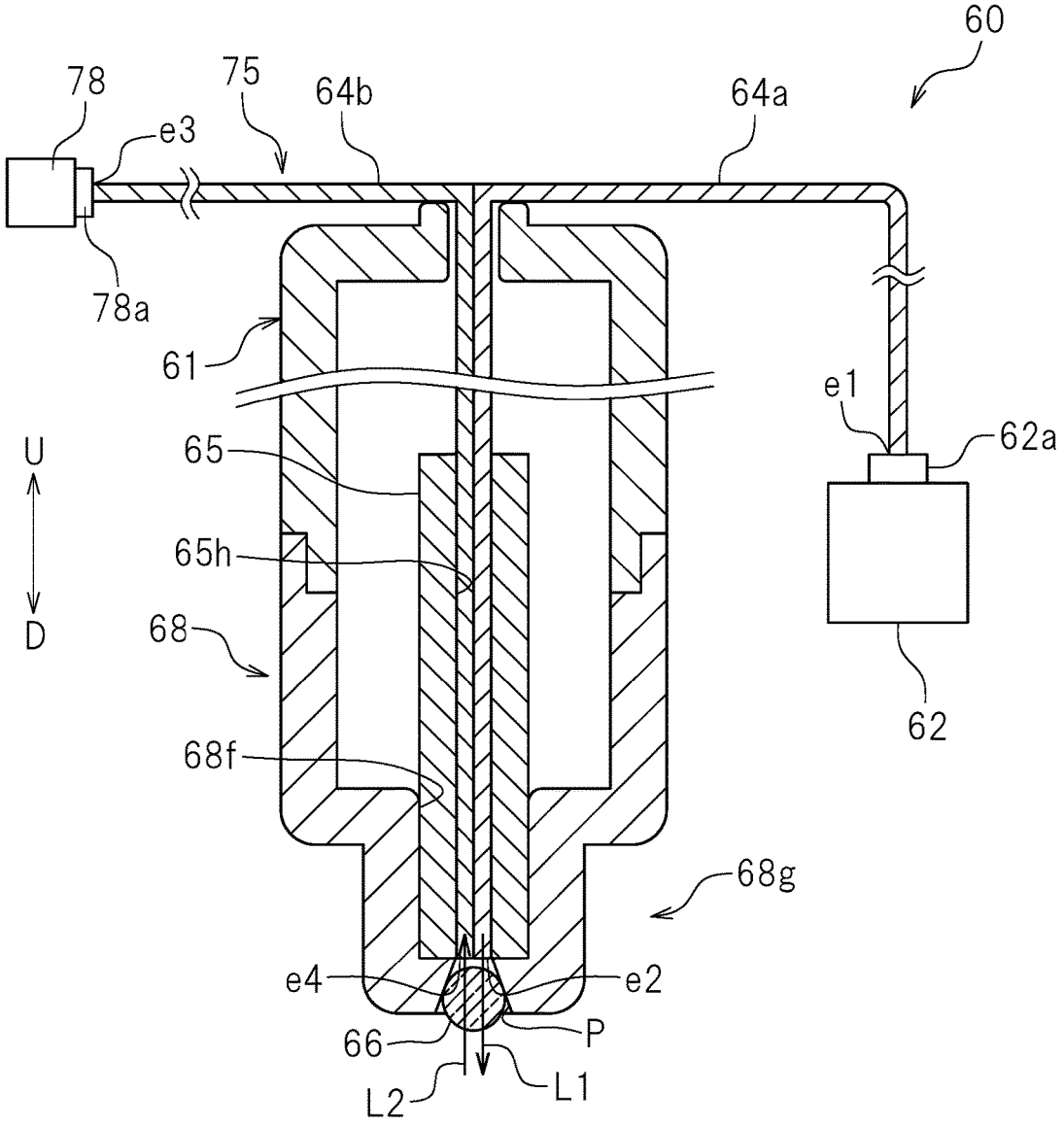
FIG. 4 is a cross-sectional view schematically showing a configuration of a foil transfer tool according to a preferred embodiment of the present invention.

FIG. 4 is a cross-sectional view schematically showing the foil transfer tool 60 according to a preferred embodiment of the present invention. The foil transfer tool 60 is mounted on the carriage 21 (see FIG. 1). The foil transfer tool 60 is arranged above the fixture 20. The foil transfer tool 60 presses the thermal transfer foil 82 placed on the transfer object 80 and the light absorbing film 84 placed on the thermal transfer foil 82 while irradiating the light absorbing film 84 with light. The foil transfer tool 60 includes the light source 62, a pen body 61, and a pressing member 66 fixed on a lower end portion of the pen body 61.

The light source 62 is a device that supplies light, which is to be a heat source, to the processed object 86 (i.e., the light absorbing film 84). The light source 62 is arranged in the case 18*a* (see FIG. 2), which is provided on the rear side of the casing 12. Light supplied to the processed object 86 is converted to thermal energy through the light absorbing film 84 to heat the thermal transfer foil 82. The light source 62 of the present preferred embodiment is a laser oscillator including a laser diode (LD) and an optical system, etc. The light source 62 is connected to the controller 90. The controller 90 controls the switching between emitting (ON) and stop emitting (OFF) laser light from the light source 62, the energy level of laser light, etc. Since laser light has a high response speed, it is possible to instantaneously change the energy level of laser light, etc., as well as to switch between emitting and not emitting light, needless to say. Thus, the light absorbing film 84 is able to be irradiated with laser light having an intended property.

The pen body 61 preferably has an elongated cylindrical shape. The pen body 61 is arranged so that the longitudinal direction coincides with the up-down direction Z. The axis of the pen body 61 extends in the up-down direction. A first optical fiber 64*a*, a second optical fiber 64*b* and a ferrule 65 are accommodated in the pen body 61. The pen body 61 includes a holder 68 to be described below. The holder 68 is attached to a lower end portion of the pen body 61.

The first optical fiber 64*a* is an optical fiber transfer medium that transfers light emitted from the light source 62. The first optical fiber 64*a* includes a core portion (not shown) that allows light to pass therethrough, and a cladding portion (not shown) that covers the core portion and reflects light. The first optical fiber 64*a* is connected to the light source 62. An upper end portion e1 of the first optical fiber 64*a* is extended out of the pen body 61. The end portion e1 of the first optical fiber 64*a* is inserted into a connector 62*a* of the light source 62. With such a configuration, the first optical fiber 64*a* is connected to the light source 62 while the optical loss is kept low. The ferrule 65 is attached to a lower end portion e2 of the first optical fiber 64*a*. The ferrule 65 is an optical coupling member having a cylindrical shape. The ferrule 65 has a through hole 65*h* extending therethrough along the cylindrical axis. The end portion e2 of the first optical fiber 64*a* is inserted into the through hole 65*h* of the ferrule 65. The first optical fiber 64*a* is an example of the first light guide.

The second optical fiber 64*b* is an optical fiber transfer medium that transfers infrared light generated in the processed object 86 (typically, the light absorbing film 84). The second optical fiber 64*b* includes a core portion (not shown) that allows light to pass therethrough, and a cladding portion (not shown) that covers the core portion and reflects light. The second optical fiber 64*b* is connected to a photodiode 78 to be described below. An upper end portion e3 of the second optical fiber 64*b* is extended out of the pen body 61. The end portion e3 of the second optical fiber 64*b* is inserted into a connector 78*a* of the photodiode 78. With such a configuration, the second optical fiber 64*b* is connected to the photodiode 78 while the optical loss is kept low. The ferrule 65 is attached to a lower end portion e4 of the second optical fiber 64*b*. The end portion e4 of the second optical fiber 64*b* is inserted into the through hole 65*h* of the ferrule 65. In the present preferred embodiment, the first optical fiber 64*a* and the second optical fiber 64*b* are attached to the ferrule 65 as a single member. The second optical fiber 64*b* is an example of the second light guide.

The pen body 61 is provided with the holder 68. The holder 68 is a holding member that holds the ferrule 65 at a predetermined position on the lower end of the pen body 61. The holder 68 has a cap shape. The shape of the upper portion of the holder 68 is a cylindrical shape whose outer diameter corresponds to the pen body 61. A cylindrical projection 68*g* whose outer diameter is smaller than the pen body 61 is provided in a lower portion of the holder 68. The projection 68*g* is provided with a ferrule holding portion 68*f*, which is a cylindrical indentation. The ferrule holding portion 68*f* has an inner diameter that corresponds to the outer diameter of the ferrule 65. The lower end of the ferrule 65 is accommodated in the ferrule holding portion 68*f*. The first optical fiber 64*a*, the second optical fiber 64*b* and the ferrule 65 are typically manufactured to have sizes based on an international standard (IEC 61755-3-1:2006).

The holder 68 includes an opening P extending therethrough in the up-down direction. The core portion of the end portion e2 of the first optical fiber 64*a* and the core portion of the end portion e4 of the second optical fiber 64*b* are exposed to the outside through the opening P. That is, as seen from below, the core portion of the end portion e2 of the first optical fiber 64*a* and the core portion of the end portion e4 of the second optical fiber 64*b* are overlapping the opening P. Thus, the holder 68 does not interfere with a light path L1 of laser light and a light path L2 of infrared light generated in the processed object 86. As a result, laser light emitted from the light source 62 is able to be output to the outside through the lower end of the pen body 61. Infrared light generated in the processed object 86 is able to be guided into the second optical fiber 64*b*.

The holder 68 holds the pressing member 66 at a predetermined position at the lower end of the pen body 61. First, the pressing member 66 will be described. The pressing member 66 presses the processed object 86 (i.e., the thermal transfer foil 82 and the light absorbing film 84). The pressing member 66 is able to be attached to and detached from the holder 68. In the present preferred embodiment, the pressing member 66 preferably has a spherical shape. The pressing member 66 is preferably made of a hard material. Although the hardness of the pressing member 66 is not limited strictly, the material thereof has a Vickers hardness of about 100 $HV_{0.2}$ or more (e.g., about 500 $HV_{0.2}$ or more), for example. The holder 68 holds the pressing member 66 on the light path L1 of laser light and the light path L2 of infrared light generated in the processed object 86. The pressing member 66 is preferably made of a material that allows light generated from the light source 62 and infrared light generated in the processed object 86 to pass therethrough. Thus, even if the pressing member 66 is arranged on the light path L1 and the light path L2, laser light and infrared light are able to pass through the pressing member 66. The pressing member 66 can be made of a glass, for example. The pressing member 66 of the present preferred embodiment is preferably made of a synthetic quartz glass.

As used herein, "pass" means that the pressing member 66 has a transmittance of about 50% or more, preferably about 70% or more, more preferably about 80% or more, and particularly preferably about 85% or more (e.g., about 90% or more), for laser light and infrared light, for example. For example, the transmittance refers to the transmittance that is measured in conformity with JIS R3106:1998 and that includes a surface reflection loss for a sample having a predetermined thickness (e.g., about 10 mm).

As shown in FIG. 2, the thermal transfer device 10 includes a temperature detector 75. The temperature detector 75 measures the process temperature of the foil transfer portion based on the infrared light generated in the processed object 86 during foil transfer. More specifically, the temperature detector 75 measures the process temperature, which is the temperature of a portion of the light absorbing film 84 that is being pressed by the pressing member 66 of the foil transfer tool 60 and irradiated with light from the light source 62, based on the infrared light generated from that portion. The infrared light from the processed object 86 is generated by the conversion of laser light emitted from the light source 62 of the foil transfer tool 60 into thermal energy through the light absorbing film 84. The temperature detector 75 includes the second optical fiber 64*b* and the photodiode 78. The photodiode 78 is arranged in the case 18*a* (see FIG. 2). The photodiode 78 is connected to the controller 90. The infrared light generated in the processed object 86 is guided into the photodiode 78 through the second optical fiber 64*b*. Thus, the process temperature is detected by the photodiode 78.

Figure 5:
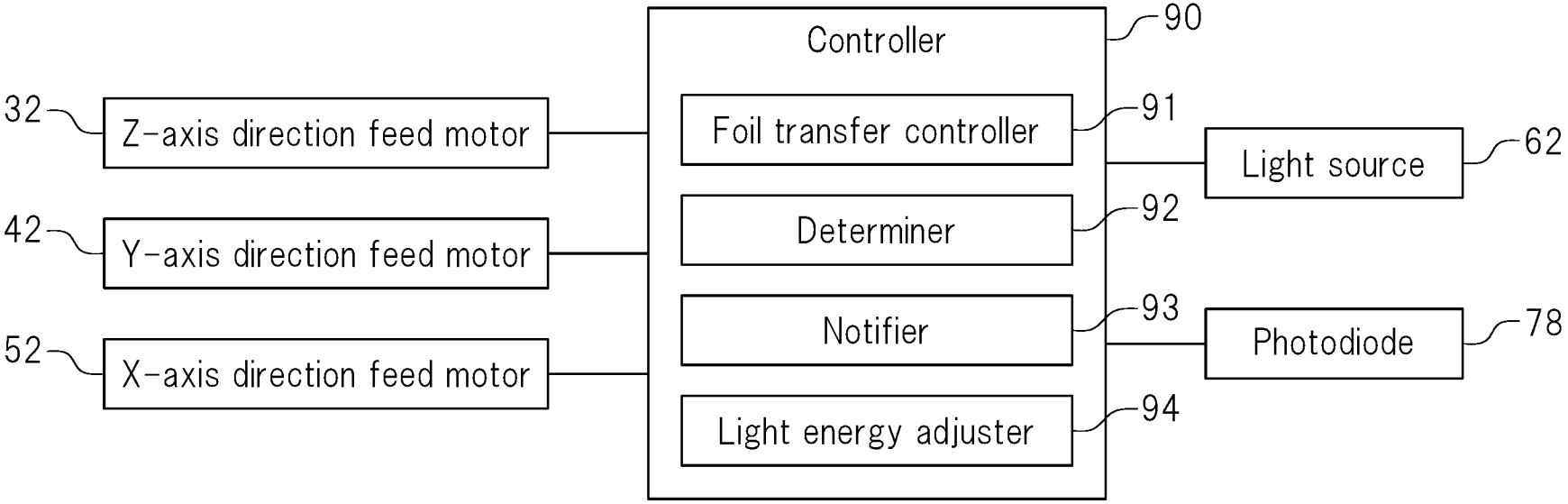
FIG. 5 is a block diagram of a controller according to a preferred embodiment of the present invention.

The overall operation of the thermal transfer device 10 is controlled by the controller 90. As shown in FIG. 5, the controller 90 is communicably connected to the Z-axis direction feed motor 32, the Y-axis direction feed motor 42, the X-axis direction feed motor 52, the light source 62 and the photodiode 78, and is able to control these components. The controller 90 is typically a computer. For example, the controller 90 includes an interface (I/F) receiving print data, etc., from an external device such as a host computer, a central processing unit (CPU) executing instructions of a control program, a ROM storing the program to be executed by the CPU, a RAM used as a working area for the execution of the program, and a storage such as a memory storing the program and various data.

The controller 90 is configured or programmed to include a foil transfer controller 91, a determiner 92, a notifier 93, and a light energy adjuster 94. These elements preferably are implemented by a program. The program is loaded from a recording medium such as a CD or a DVD, for example. Note that the program may be downloaded through the Internet. These elements may be implemented by a processor and/or a circuit, etc. Note that how these elements are controlled specifically will be described below.

The foil transfer controller 91 moves the foil transfer tool 60 relative to the fixture 20 by the carriage moving mechanism so as to press the thermal transfer foil 82 and the light absorbing film 84 placed on the transfer object 80 while irradiating the light absorbing film 84 with light, thus performing a foil transfer control of foil-transferring the thermal transfer foil 82 onto the transfer object 80. The foil transfer controller 91 moves the foil transfer tool 60 by moving the carriage 21 in the X-axis direction, the Y-axis direction and the Z-axis direction. The foil transfer controller 91 performs a control of emitting and stopping emitting laser light from the light source 62. The foil transfer controller 91 is controlled based on foil transfer data. The foil transfer data is data of a design pattern, etc., input by the user, and is represented in the form of raster data, for example.

The determiner 92 determines whether or not the process temperature measured by the temperature detector 75 is within a predetermined temperature range. The predetermined temperature range varies depending on the property of the adhesive layer of the thermal transfer foil 82 placed on the transfer object 80. For example, the predetermined temperature range is about 100° C. to about 200° C. Predetermined temperature ranges for thermal transfer foils 82 to be used are stored in advance in the controller 90.

The notifier 93 provides a notification that the foil transfer is being performed normally when it is determined by the determiner 92 that the process temperature is within the predetermined temperature range. On the other hand, the notifier 93 provides a notification that the foil transfer is not being performed normally when it is determined by the determiner 92 that the process temperature is outside the predetermined temperature range. Although there is no particular limitation on how a notification is given by the notifier 93, the foil transfer result may be displayed on a display device (not shown) connected to the thermal transfer device 10, or a notification may be given by generating a predetermined sound (e.g., a voice), for example.

The light energy adjuster 94 adjusts the light energy emitted from the light source 62 of the foil transfer tool 60 when it is determined by the determiner 92 that the process temperature is outside the predetermined temperature range. For example, when the process temperature is above the predetermined temperature range, the light energy adjuster 94 decreases the energy of light emitted from the light source 62. When the process temperature is below the predetermined temperature range, the light energy adjuster 94 increases the energy of light emitted from the light source 62.

The controller 90 performs a foil transfer based on the foil transfer data. Specifically, the foil transfer controller 91 drives the Z-axis direction feed motor 32, the Y-axis direction feed motor 42 and the X-axis direction feed motor 52 so as to move the foil transfer tool 60. For example, the foil transfer controller 91 presses the thermal transfer foil 82 and the light absorbing film 84 by the pressing member 66 of the foil transfer tool 60 based on the foil transfer data. At the same time, the foil transfer controller 91 actuates the light source 62 with predetermined timing based on the foil transfer data so as to emit laser light from the foil transfer tool 60 toward the light absorbing film 84 of the processed object 86. Moreover, the foil transfer controller 91 drives the Y-axis direction feed motor 42 so as to move the foil transfer tool 60 in the front-rear direction relative to the processed object 86 based on the foil transfer data.

In this process, in a portion of the processed object 86 that is irradiated with laser light, the light absorbing film 84 absorbs the laser light and converts light energy into thermal energy. Therefore, the light absorbing film 84 generates heat, and the heat is transmitted to the adhesive layer of the thermal transfer foil 82. Thus, the adhesive layer softens and exerts its adhesiveness. The adhesive layer sticks to the surface of the decorative layer and the surface of the transfer object 80, thus causing the decorative layer and the transfer object 80 to adhere together. Thereafter, the supply of the light energy to the irradiated portion stops as the foil transfer tool 60 moves or as the emission of laser light from the light source 62 is stopped. Then, the adhesive layer cools through heat radiation, and cures. Thus, the decorative layer is firmly bonded to the surface of the transfer object 80. Thereafter, the user removes the base material of the thermal transfer foil 82 and the light absorbing film 84 from the surface of the transfer object 80 to obtain a transfer article where an intended design pattern, etc., has been thermal-transferred onto the surface of the transfer object 80.

Note that as the light absorbing film 84 generates heat, infrared light is generated from a portion thereof that has been irradiated with laser light. The generated infrared light is transmitted to the photodiode 78 through the second optical fiber 64*b*. Thus, the process temperature of the portion that has been irradiated with laser light is measured. As described above, there is a suitable process temperature range for the thermal transfer foil 82 depending on the property of the adhesive layer. When the process temperature measured by the photodiode 78 is within a predetermined temperature range, the adhesive layer suitably sticks to the surface of the decorative layer and the surface of the transfer object 80. On the other hand, when the process temperature measured by the photodiode 78 is outside the predetermined temperature range, the adhesion between the decorative layer and the transfer object 80 by the adhesive layer may possibly be insufficient. When the process temperature measured by the photodiode 78 is within the predetermined temperature range, the notifier 93 provides a notification that the foil transfer is being performed normally. On the other hand, when the process temperature measured by the photodiode 78 is outside the predetermined temperature range, the notifier 93 provides a notification that the foil transfer is not being performed normally, and the light energy adjuster 94 increases or decreases the energy of light emitted from the light source 62 in accordance with the measured temperature.

As described above, with the thermal transfer device 10 of the present preferred embodiment, it is possible to measure the process temperature, which is the temperature of a portion of the light absorbing film 84 placed on the transfer object 80 and the thermal transfer foil 82 that is being pressed by the pressing member 66 of the foil transfer tool 60 and irradiated with laser light from the light source 62. Thus, it is possible to check whether or not the process temperature is within an optimal temperature range for the foil transfer of the thermal transfer foil onto the transfer object. That is, when the process temperature is below the temperature range, it is possible to increase the light energy to be emitted from the light source 62 of the foil transfer tool 60 to increase the process temperature so that the thermal transfer foil 82 is able to be more reliably transferred onto the transfer object 80. On the other hand, when the process temperature is above the temperature range, it is possible to decrease the light energy to be emitted from the foil transfer tool 60 to decrease the process temperature so that the thermal transfer foil 82 is able to be more reliably transferred onto the transfer object 80. Since it is possible to measure the process temperature during the foil transfer, it is possible to more reliably foil-transfer the thermal transfer foil 82 onto the transfer object 80 even when the material, etc., of the transfer object 80 are unknown and the light energy to be emitted from the light source 62 cannot be precisely set in advance.

With the thermal transfer device 10 of the present preferred embodiment, the notifier 93 provides a notification that the foil transfer is being performed normally when it is determined by the determiner 92 that the process temperature is within the predetermined temperature range. The notifier 93 provides a notification that the foil transfer is not being performed normally when it is determined by the determiner 92 that the process temperature is outside the predetermined temperature range. Thus, the operator is able to recognize whether or not the thermal transfer foil 82 is being reliably foil-transferred onto the transfer object 80.

With the thermal transfer device 10 of the present preferred embodiment, the light energy adjuster 94 adjusts the energy of light emitted from the light source 62 of the foil transfer tool 60 when it is determined by the determiner 92 that the process temperature is outside the predetermined temperature range. For example, the light energy adjuster 94 decreases the energy of light emitted from the foil transfer tool 60 when the process temperature is above the predetermined temperature range. The light energy adjuster 94 increases the energy of light emitted from the foil transfer tool 60 when the process temperature is below the predetermined temperature range. Thus, it is possible to generate an appropriate amount of heat in the light absorbing film 84 so that the thermal transfer foil 82 is able to be reliably foil-transferred onto the transfer object 80.

With the thermal transfer device 10 of the present preferred embodiment, the foil transfer tool 60 is provided in the holder 68 of the pen body 61, and includes the pressing member 66 to press the thermal transfer foil 82 and the light absorbing film 84 placed on the transfer object 80. The pressing member 66 is preferably made of a material that allows laser light generated from the light source 62 to pass therethrough. Thus, since the pressing member 66 allows laser light to pass therethrough, a portion of the light absorbing film 84 that is being pressed by the pressing member 66 is able to be irradiated with laser light. As a result, an amount of heat needed for the foil transfer is able to be generated in the light absorbing film 84, and it is possible to more accurately foil-transfer the thermal transfer foil 82 onto the transfer object 80.

With the thermal transfer device 10 of the present preferred embodiment, the pressing member 66 is able to be attached to and detached from the holder 68 of the pen body 61. Since the pressing member 66 is used while in contact with the light absorbing film 84, the pressing member 66 gradually wears out. Since only the pressing member 66 is needed to be replaced in the present preferred embodiment, the replacement is easy and low-cost as compared with a case in which the entire foil transfer tool 60 is replaced.

With the thermal transfer device 10 of the present preferred embodiment, the end portion e4 of the second optical fiber 64*b* of the temperature detector 75 is arranged in the holder 68 of the pen body 61 so as to face the pressing member 66 inside the pen body 61. Thus, it is possible to more accurately measure the process temperature.

Preferred embodiments of the present invention have been described above. However, the preferred embodiments described above are merely illustrative, and the present invention can be carried out in various other preferred embodiments.

While the foil transfer tool 60 is moved relative to the fixture 20 in the preferred embodiments described above, the present invention is not limited thereto. For example, the thermal transfer device 10 may be structured so that the fixture 20 is moved relative to the foil transfer tool 60, or the fixture 20 and the foil transfer tool 60 may both be movable. For example, the fixture 20 may be movable in the X-axis direction while the foil transfer tool 60 is movable in the Y-axis direction and the Z-axis direction.

The pressing member 66 preferably has a spherical shape in the preferred embodiments described above, for example. However, the shape of the pressing member 66 is not limited thereto. For example, the pressing member 66 may be semi-spherical or rectangular parallelepiped.

The light energy adjuster 94 increases or decreases, depending on the measured temperature, the energy of light emitted from the light source 62, when the process temperature measured by the photodiode 78 is outside the predetermined temperature range in the preferred embodiments described above. However, the present invention is not limited thereto. For example, when the process temperature measured by the photodiode 78 is outside the predetermined temperature range, the notifier 93 may only give a notification that the foil transfer is not being performed normally. That is, the controller 90 does not need to include the light energy adjuster 94. In such a case, the light energy emitted from the light source 62 is adjusted by the user himself/herself.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or described during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A thermal transfer device comprising:

a holding table that holds a transfer object;

a foil transfer tool that presses a thermal transfer foil placed on the transfer object and a light absorbing film with a light absorbing property placed on the thermal transfer foil and emits light onto the light absorbing film;

a moving mechanism that moves one of the holding table and the foil transfer tool relative to the other; and a temperature detector that measures a process temperature, which is a temperature of a portion of the light absorbing film pressed and irradiated with light by the foil transfer tool, wherein the foil transfer tool includes:

a hollow pen body including a tip;

a pressing body that is provided in the tip of the pen body and presses the thermal transfer foil and the light absorbing film placed on the transfer object;

a first light guide including a first end and a second end and at least partially located inside the pen body; and a light source connected to the first end of the first light guide;

the second end of the first light guide is located in the tip of the pen body so as to face the pressing member inside the pen body;

the pressing member is made of a material that allows light emitted from the light source to pass therethrough;

the temperature detector includes:

a second light guide including a first end and a second end and at least partially located inside the pen body; and a photodiode connected to the first end of the second light guide; and the second end of the second light guide is located in the tip of the pen body so as to face the pressing member inside the pen body.

2. The thermal transfer device according to claim 1, comprising:

a controller that is communicably connected to the foil transfer tool, the moving mechanism and the temperature detector, the controller including:

a foil transfer controller that moves the foil transfer tool and the holding table relative to each other by the moving mechanism so as to press the thermal transfer foil and the light absorbing film while irradiating the light absorbing film with light to perform a foil transfer control of foil-transferring the thermal transfer foil onto the transfer object;

a determiner that determines whether or not the process temperature measured by the temperature detector is within a predetermined temperature range; and a notifier that provides a notification that the foil transfer is being performed normally when the determiner determines that the process temperature is within the predetermined temperature range, and provide a notification that the foil transfer is not being performed normally when the determiner determines that the process temperature is outside the predetermined temperature range.

3. The thermal transfer device according to claim 2, wherein the controller includes a light energy adjuster that adjusts an energy of light emitted from the foil transfer tool when the determiner determines that the process temperature is outside the predetermined temperature range.

4. The thermal transfer device according to claim 1, wherein the pressing member is attachable to and detachable from the tip of the pen body.

* * * * *